US007140318B1

(12) United States Patent
Gasper

(10) Patent No.: US 7,140,318 B1
(45) Date of Patent: Nov. 28, 2006

(54) METHOD AND APPARATUS FOR MODIFYING WAKE

(75) Inventor: Daniel L. Gasper, Merced, CA (US)

(73) Assignee: Malibu Boats West, Inc., Merced, CA (US)

( * ) Notice: Subject to any disclaimer, the term of this patent is extended or adjusted under 35 U.S.C. 154(b) by 0 days.

(21) Appl. No.: 11/301,852

(22) Filed: Dec. 12, 2005

(51) Int. Cl.
*B63B 1/30* (2006.01)
*B63B 1/22* (2006.01)

(52) U.S. Cl. ..... 114/282; 114/285

(58) Field of Classification Search ..... 114/271, 114/274, 275, 280, 282, 284
See application file for complete search history.

(56) References Cited

U.S. PATENT DOCUMENTS

| | | | | |
|---|---|---|---|---|
| 2,081,868 | A | 5/1937 | Hampden | |
| 3,094,960 | A | 6/1963 | Lang | |
| 3,294,052 | A | 12/1966 | Jones | |
| 4,915,048 | A | 4/1990 | Stanford | |
| 5,315,951 | A * | 5/1994 | Finkl | 114/280 |
| 5,549,071 | A | 8/1996 | Pigeon | |
| 5,860,384 | A * | 1/1999 | Castillo | 114/280 |
| 6,745,715 | B1 * | 6/2004 | Shen et al. | 114/284 |
| 6,941,884 | B1 * | 9/2005 | Moore | 114/284 |
| 2005/0155540 | A1 | 7/2005 | Moore | |

FOREIGN PATENT DOCUMENTS

NO 86945 2/1956

OTHER PUBLICATIONS

*MALIBU—RESPONSE*, Performance Wakeboard Report, 1997, vol. 1, issue 1, pp. 16-17, Performance Report Magazines, Inc., Hood River, Oregon.

*MALIBU WEDGE*, Performance Wakeboard Report, 1997, vol. 1, issue 3, p. 43, Performance Report Magazines, Inc., Hood River, Oregon.

*SKI LOCKER—Trim The Waves to Suit Your Personality*, Trailer BOATS (as reprinted at http://www.switchbladewake.com/switchblade.pdf), Jul. 2005, EHLERT Inc.

* cited by examiner

*Primary Examiner*—Jesús D. Sotelo
(74) *Attorney, Agent, or Firm*—Dorsey & Whitney LLP

(57) ABSTRACT

An adjustable wake setting device for modifying a wake produced by a watercraft traveling through water. The system has a mounting member dimensioned and configured for attachment to the watercraft, a foil dimensioned and configured for movement between a stowed position adjacent the mounting member, out of the water, and an active area below the mounting member, in the water, such that the foil adjusts a relative position of the watercraft in the water thereby modifying the wake produced by the water craft traveling through the water, a linkage movably securing the foil to the mount, the linkage being dimensioned and configured for adjustably positioning the foil in the stowed position and the active area, an actuator mounted on the mounting member and connected to the linkage for moving the linkage such that the foil moves between the stowed position and the active area, and a controller for selectively actuating the actuator thereby selectively moving the foil between the stowed position and the active area. A method of using the adjustable wake setting device is also disclosed.

31 Claims, 5 Drawing Sheets

METHOD AND APPARATUS FOR MODIFYING WAKE

TECHNICAL FIELD

This invention relates, in general, to methods and apparatus for modifying wakes, and more particularly to remotely adjusting the wake behind powerboats towing wake boarders and water-skiers.

BACKGROUND OF THE INVENTION

In water sports, a typical tow boat is operated at speeds in excess of 15 mph. At these speeds, the boat hull creates a trailing wake with a low, turbulent middle developing near the stern of the boat. The outer edge of the wake forms a V-shaped lip with water outside the middle of the wake.

As a boat travels through the water, the stern of the boat hull lowers in the water and the bow rises at an angle of attack to oncoming water. The stern of the boat hull displaces water, which effectively creates the wake behind the boat. A heavier boat lying lower in the water will create a larger wake due to the greater water displacement. The shape of the hull also affects the wake shape and size.

While often referred to generically as "waterskiing" and "wake boarding", water sports utilizing a tow boat generally encompass many different sports using skis, skates, boards, water foils, and even bare feet. With the advent of wakeboarding and trick skiing, the wake shape has become a more prominent component of the water-ski sports and tow boats. Many of these sports, especially wakeboarding, primarily focus on use of the wake to perform aerial maneuvers.

Typical wakeboards have a wide and flat form for sliding over the water surface. In comparison to water skiing or hydrofoil water sports, a wakeboarder is pulled through the water at a lower speed, typically in the range of 15–25 mph.

Wakeboarding and trick skiing enthusiasts, in particular, use the wake repetitively as a "ramp" by jumping over the wake. As such, the size of the wake is of primary concern for wakeboarders. As the sport has matured, wakeboard enthusiasts have developed increasingly complex tricks like spins, grabs, and flips. A larger wake allows wakeboarders to get more "air" when crossing over the wake, meaning that the rider can jump higher over the wake.

In order to increase the wake size, enthusiasts and boat designers have employed various techniques for lowering the stern of the boat and increasing wake size. One simple method is to place weights in the stern of the boat. Some tow boats have been designed specifically with additional weight in the transom for this purpose. The additional weight lowers the stern of the boat during towing and increases the size of the wake, however, there are several disadvantages to this method. The lowered floating position of the boat translates into slower cruising speeds. This is disadvantageous when the boat is used for cruising rather than skier towing. It can also be disadvantageous when one desires to use the same boat for pulling wakeboarders at slower speeds with a larger wake and skiers at high speeds with a small wake. One cannot increase or decrease the wake size and maintain a top cruising speed without stopping ashore to load or unload the weights.

Furthermore, the additional weight poses a safety risk. Every boat has a maximum load capacity, and the additional weight lowers the margin of safety. Typical weight additions can be from 800–1200 pounds. In a smaller boat, this additional weight combined to the passenger weight can be close to the maximum rated load-capacity.

Another class of boats has been developed to adjust the wake. These tow boats, known generally as "tournament boats," have been developed for competitive skiing. The hull section of these boats are relatively flat such that minimal wake is produced at speed. The smaller wake is suitable for high-speed skiing and slalom competitions requiring precise turning patterns. Because these boats do not employ a deep V-shaped hull, they have lower top speeds typically under 50 mph. These boats are said to run "wet," meaning that they have high drag from the added area contacting the water surface. Tournament boats also employ control devices for changing the size of the wake. Several devices have been employed to balance the need for less drag with a smoother wake. An example of such a control device is disclosed in U.S. Pat. No. 5,549,071. Generally, these devices and designs minimize the wake size, which is not desirable for wakeboarding and trick skiing.

In contrast to tournament boats with smooth wakes, some boats have a hull designed with a deep deadrise. A deep deadrise creates a larger wake preferable for trick skiing. However, all the hull designs require a tradeoffs between speed and wake size.

U.S. Pat. No. 4,915,048 to Stanford discloses a submerged hydrofoil device for adjusting the trim and stability of a tow boat. The hydrofoil is also integral to the boat design and cannot be retracted for cruising. Norwegian patent no. 86,945 to Troenge is directed to a retractable stern-mounted foil. However, similar to the Stanford patent, Troenge is directed to improved stability and not adjustment of the wake size. Both patents are directed to adjusting and balancing the pitch and yaw forces and angle of attack of the tow boat.

Some submerged hydrofoil devices have been employed specifically to increase wake size. These hydrofoil devices increase downforce on the boat hull and in turn increase the wake size. Fixed hydrofoil devices are limited in that they do not allow for adjustment of the wake size; the single position of the hydrofoil allows for only a single wake size at a particular speed. In particular, known hydrofoil devices either require manual removal of the hydrofoil at cruising speed or they cannot be removed at all. If removable, these devices require manually removing the hydrofoil. If the hydrofoil is not retracted, it decreases the top speed of the boat. Thus, known hydrofoil devices are fixed or cannot be easily adjusted between cruising and towing conditions.

Newer methods have been devised which allow for increasing the wake size at tow speed without sacrificing cruising speed. One such method uses of an inflatable bladder. When towing riders, the bladder can be filled with water to increase weight in the stern of the boat. At cruising speeds, the water in the bladder can be excreted out of the boat. This device has the limitation of requiring users to wait for the bladder to be filled and emptied and also has limited adjustability. Moreover, the increased weight of the bladder also lowers the loading margin of safety as discussed.

What is needed is a method and apparatus that allows adjustable wake modification while overcoming the above-mentioned disadvantages.

BRIEF SUMMARY OF THE INVENTION

In summary, one aspect of the present invention is directed to a wake modifying system for modifying a wake produced by a watercraft traveling through water. The system has a mounting member dimensioned and configured for attachment to the watercraft, a foil dimensioned and configured for movement between a stowed position adjacent the mounting member, out of the water, and an active area below the mounting member, in the water, such that the foil adjusts a relative position of the watercraft in the water thereby modifying the wake produced by the water craft traveling through the water, a linkage movably securing the foil to the mount, the linkage being dimensioned and configured for adjustably positioning the foil in the stowed position and the active area, an actuator mounted on the mounting member and connected to the linkage for moving the linkage such that the foil moves between the stowed position and the active area, and a controller for selectively actuating the actuator thereby selectively moving the foil between the stowed position and the active area.

The active area may include a plurality of active positions, wherein each active position of the foil modifies the wake in varying degree. The plurality of active positions of the foil may be incrementally spaced within the active area. The actuator may be a step motor configured for moving the foil between the incrementally spaced active positions. The mounting member may be mounted to a transom of the watercraft.

The actuator may include at least one linear actuator having one end pivotally attached to the mounting member and another end pivotally attached to the linkage, and, the controller may be configured to output a control signal to the at least one linear actuator such that the actuator moves the linkage to move the foil between the stored position and active area. The controller may be configured for control by a user within the watercraft.

The controller may be configured to control the actuator in response to one or more operational parameters of the watercraft. The controller may be configured to prohibit the actuator from moving the linkage and foil between the stored position and active area unless speed of the watercraft may be less than a predetermined threshold speed. The predetermined threshold speed may be approximately 10 miles per hour. The controller may be configured to allow the actuator to move the linkage and foil between a plurality of active positions within the active area when the speed of the watercraft may be above the predetermined threshold speed but below a predetermined maximum speed. The predetermined maximum speed may be approximately 25 miles per hour. The controller may be configured to prevent the actuator to move the linkage and foil between a plurality of active positions within the active area when the speed of the watercraft may be greater than approximately 10 miles per hour. The controller prohibits the actuator from moving the linkage and the foil when the speed of the watercraft may be approximately zero.

Another aspect of the present invention is directed to a wake modifying system for modifying a wake produced by a watercraft moving through water. The system includes a mounting body, the mounting body being configured to be secured to the watercraft, a linkage including an arm being pivotably attached at an upper end thereof to the mounting body, a water foil attached to a lower end of the arm, the water foil being dimensioned and configured for movement between a stowed position adjacent the mounting body and an active area below the mounting member, the water foil being configured for enhancing the wake produced by the moving watercraft, and an actuator pivotably attached at one end to the mounting body and pivotably attached at another end to the arm adjacent the upper end. The actuator may be configured for positioning the arm and the water foil in response to a control signal.

The mounting body may be secured to a transom of the watercraft. The linkage may include a pair of arms, each arm being pivotably attached at an upper end thereof to the mounting body and attached at a lower end thereof to the water foil, wherein the actuator may be configured to stow between the pair of arms when the foil may be in the stowed position. In the stowed position, the actuator may be positioned substantially within a cavity formed by the mounting body and the pair of arms, and the foil may be positioned aft of the mounting body. The mounting body may include a forward mounting plate, opposing sidewalls extending from side edges of the mounting plate, each sidewall having a pivot point for pivotal attachment of a respective one of said arms, and a top member extending from an upper edge of the mounting plate and interconnecting the sidewalls. A rear portion of the top member may form an attachment portion to which the actuator may be pivotably attached.

The water foil may have a leading edge and trailing edge, and the leading edge may extend along a transverse axis at a sweep angle. The water foil may have a non-planar cross-section configured for producing downforce when in the active area and moving through water. The water foil may be dimensioned and configured to be positioned between 0 degrees and 45 degrees relative to the longitudinal axis of the watercraft. A fore-and-aft dimension of the arms may be substantially less than a fore-and-aft dimension of the water foil.

Yet another aspect of the present invention is directed to method of modifying a wake produced by a watercraft moving through water. The method may include one or more of the steps: providing a water foil dimensioned and configured to adjust the relative position of the watercraft moving through water relative to the waterline; providing an actuator to move the water foil from a stored position out of the water to an active area within the water, wherein the relative angle of the water foil within the active area varies the amount of adjustment of the relative position; and remotely controlling the actuator to selectively move the water foil.

The method may further include incrementally controlling the relatively angle of the water foil within the active area to modify the wake in varying degree. The remotely controlling step may be accomplished by a user controlling the actuator remotely from within the watercraft. The remotely controlling step may be accomplished by automatically controlling the actuator in response to one or more operational parameters of the watercraft. The method may further include prohibiting the actuator from moving the linkage and foil between the stored position and active area unless speed of the watercraft may be less than a predetermined threshold speed. The method may further include allowing the actuator to move the linkage and foil between a plurality of active positions within the active area when the speed of the watercraft may be above the predetermined threshold speed but below a predetermined maximum speed. The method may further include allowing the actuator to move the linkage and foil between a plurality of active positions within the active area when the speed of the watercraft may be greater than approximately 10 miles per hour. The method may further include preventing the actuator from moving the linkage and the foil when the speed of the watercraft may be approximately zero.

The method and apparatus for modifying wake of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

For convenience in explanation and accurate definition in the appended claims and detailed description, the terms "up" or "upper", "down" or "lower", "inside" and "outside", "fore" or "forward" and "aft" are used to describe features of the present invention with reference to the positions of such features as displayed in the figures.

While reference will be made to towing a wakeboarder, it will be understood that the present invention can be applied to all manner of watersports where it is desirable to increase and adjust or otherwise modify the wake of a watercraft.

Figure 2:
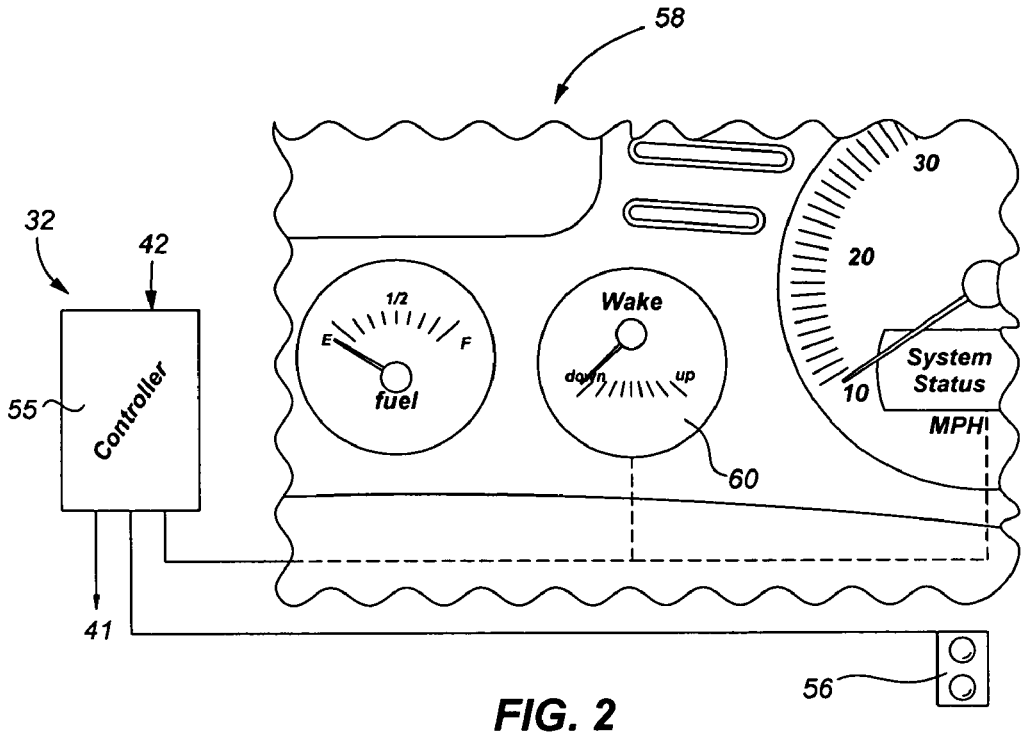
FIG. 2 is schematic view of an instrumentation and control system for controlling the wake modifier of FIG. 1.
Figure 1:
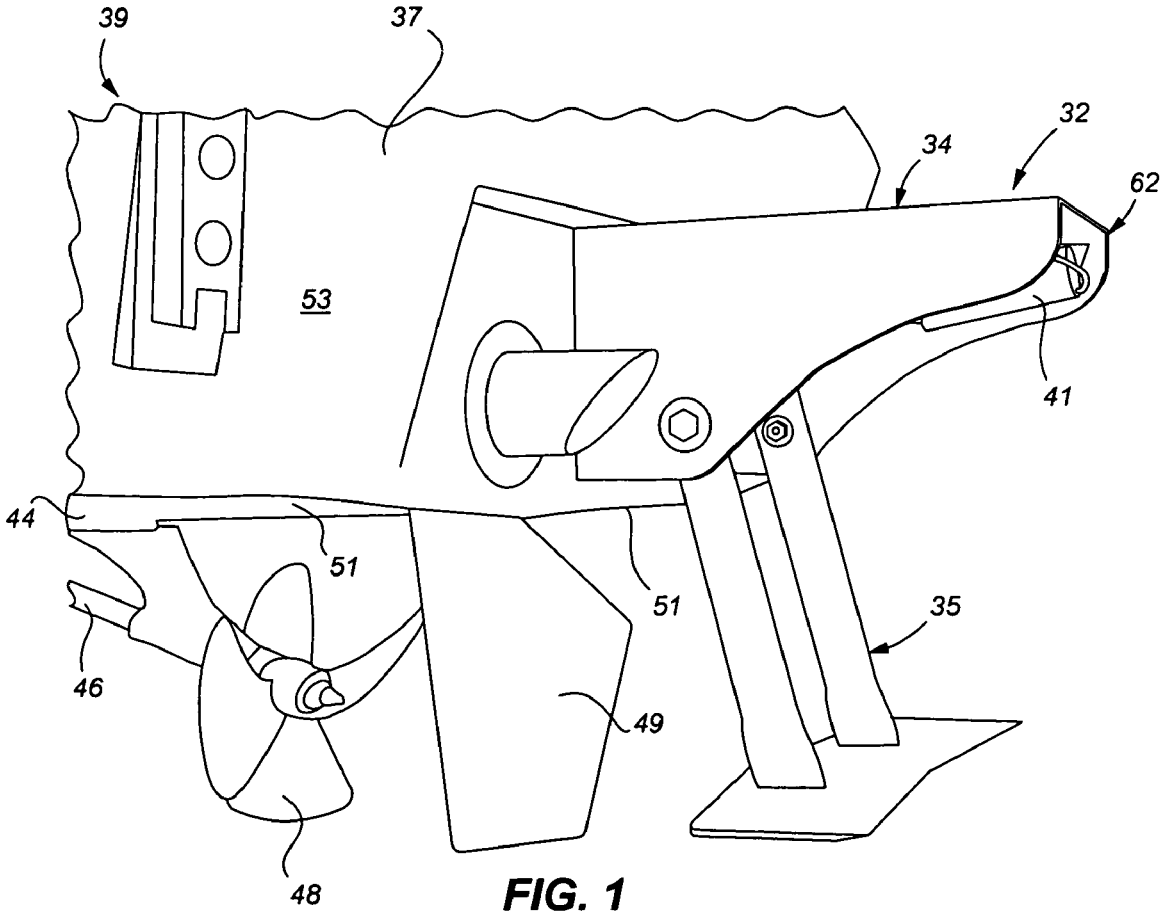
FIG. 1 is a perspective view of a wake modifier in accordance with the present invention, the apparatus shown mounted on a boat.

Referring to FIGS. 1 and 2, a wake modifying system, referenced by the numeral 32, generally includes a wake modifying device 34 having a foil assembly 35 adjustably mounted on a stern end 37 of a watercraft 39. The wake modifying device includes an actuator 41 for adjustably setting the position of the foil assembly, which actuator is remotely controlled by a control system 42 mounted within the watercraft. The wake modifying system allows the boat operator to adjust the trailing wake of a watercraft thus allowing the boat operator to enhance the recreational enjoyment and challenges for a wakeboarder being towed by the boat.

With reference to FIG. 1, the watercraft has a hull bottom 44 from which a propeller shaft 46 extrudes to drive propeller 48 in a conventional manner. A rudder 49 is mounted from the hull and adjacent the drive propeller in a conventional manner. The hull of power boats are typically V-shaped formed by generally symmetrical sides 51 converging along a longitudinal axis of the watercraft. As the watercraft moves through and displaces water, a wake is formed aft of the stern end transom 53 of the watercraft. As briefly discussed above, the shape of the hull and the depth at which the hull moves through the water effects the shape and size of the wake.

The control system includes a controller 55 that is operationally connected to actuator 41 of the wake modifying device and a control input 56 to control the position of the foil assembly. The control input may take the form of a toggle switch, control lever, push button or other suitable means. In the illustrated embodiment, the controller is also connected with an instrumentation panel 58, which displays data from the onboard control and diagnostics system of the watercraft, as shown in FIG. 2. The instrumentation panel may include information such as fuel level, watercraft speed, engine speed and other conventional information useful in the operation of the watercraft. In accordance with the present invention, the instrumentation panel may also include information about the wake modifying system including the status thereof. For example, a status gauge 60 may be provided to inform the operator of the position of the foil assembly. One will appreciate, however, that the controller need not be connected to the watercraft electronics and may, instead, be discrete from the controls and instrumentation of the watercraft. Controller 55 may take the form of any processor controller including, but not limited to, a central processing unit (CPU) that is independent of, or integral with, the control system of the watercraft.

Figure 4:
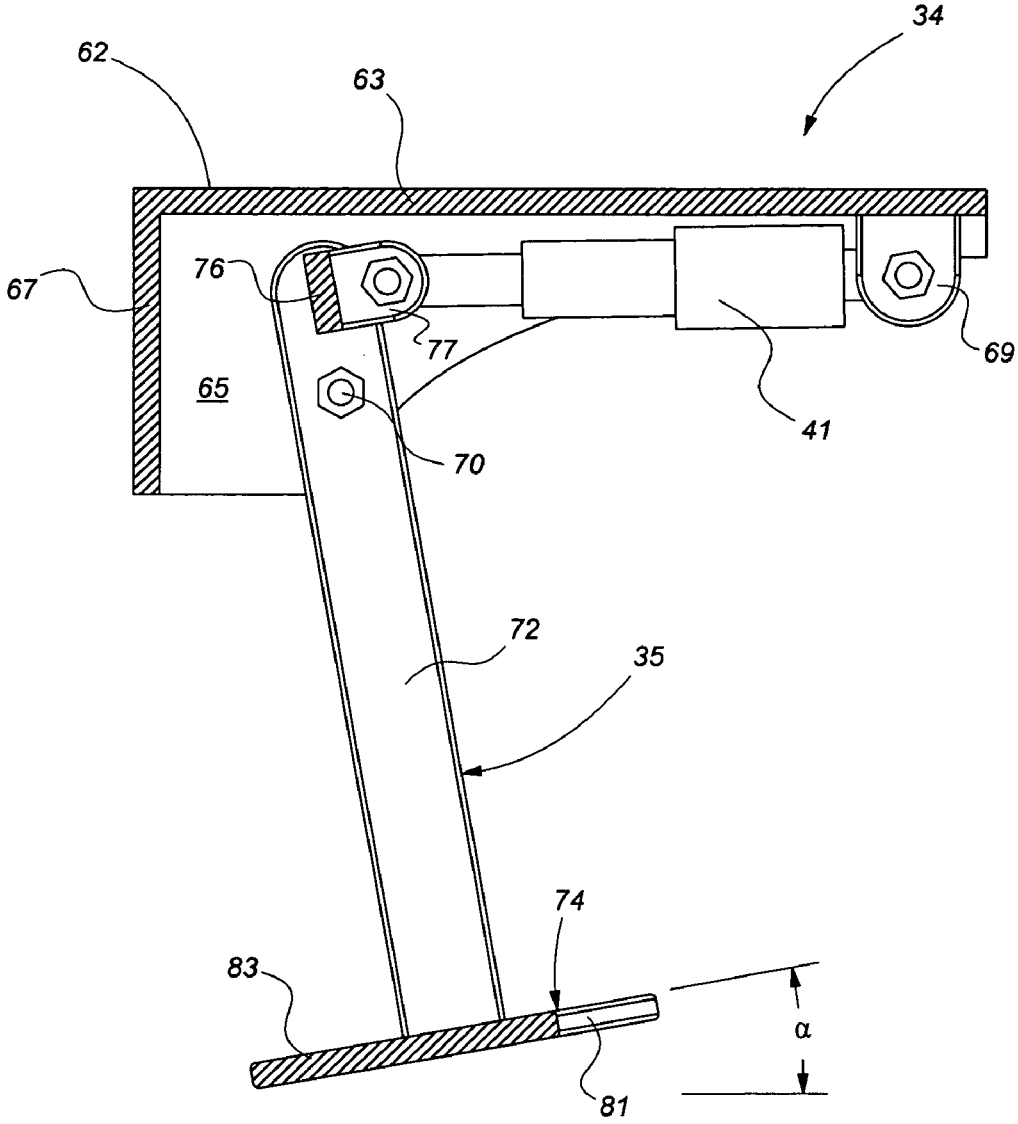
FIG. 4 is a cross-sectional side view of the wake modifier of FIG. 1.

FIG. 4 shows a detailed view of the wake modifying device 34 of FIG. 1. In the illustrated embodiment, a mounting member or body 62 is mounted to the stern end transom 53 of watercraft 39, which is at the rear of watercraft 39. Mounting body 62 is formed by a top member 63, sidewalls 65, and a mounting plate 67. Mounting body 62 may be a monolithically formed component or may be separate pieces welded or fixed together by other suitable means. In the illustrated embodiment, the mounting body is formed of stainless steel, however, one will appreciate that other suitable materials may be used including, but not limited to, aluminum, aluminum alloys, composites, and other suitable materials. The illustrated embodiment also includes substantially closed planar members, however, on will appreciate that other suitable members may be utilized to provide the appropriate framework for movably mounting the foil assembly to the stern of the watercraft.

Mounting plate 67 mounts the mounting body to watercraft 39. Opposing sidewalls 65 extend from side edges of the mounting plate. Top member 63 extends rearwardly from an upper edge of the mounting plate and are affixed to at least a portion of upper edges of the sidewalls. A rear portion of top member 63 is provided with rearward attachment flanges 69 for pivotally supporting actuators 41, while a portion of each sidewall 65 is provided with a pivot 70 for pivotally supporting foil assembly 35. In the illustrated embodiment, the pivot is formed with a through-bolt, however, one will appreciate that other suitable means may be utilized. Pivot 70 is preferably at a lower end of the sidewalls to maintain foil assembly 35 as low as possible. Additionally, locating the pivot point lower than the attachment flanges creates a configuration whereby actuators 41 can be utilized to apply an extension force versus pulling force. Furthermore, such configuration subjects the actuators to compressive forces as opposed to tension forces during operation.

The foil assembly, generally designated 35, is movably secured to mounting body 62 and includes a pair of arms 72 and a water foil 74. In the illustrated embodiment, the foil assembly is formed of stainless steel, however, one will appreciate that other suitable materials may be used including, but not limited to, bronze, aluminum, aluminum alloys, composites, and other suitable materials. The arms each have two openings at an upper end thereof for receiving a respective through-bolt to provide a pivotal connection between the arm and the mounting body. Further, upper ends of the arms are interconnected by a transverse bracket 76 including forward attachment flanges 77 secured to forward ends of actuators 41. The illustrated transverse bracket is affixed to the upper ends of the arms by bolts, welding, or other suitable means. One will appreciate, however, that the transverse bracket may be integral with, and/or monolithically formed with the arms.

Figure 3:
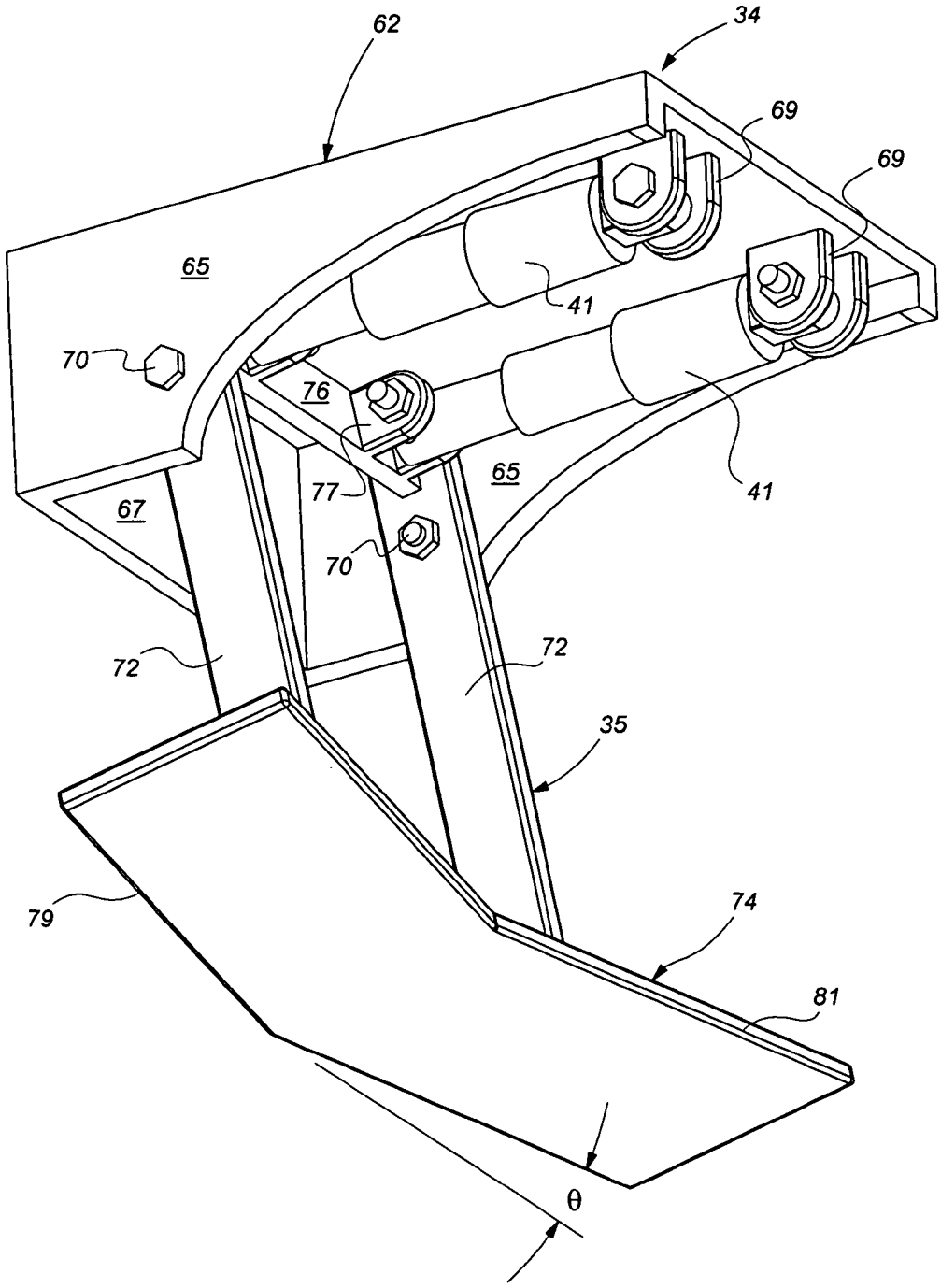
FIG. 3 is a perspective view of the wake modifier of FIG. 1.
Figure 5:
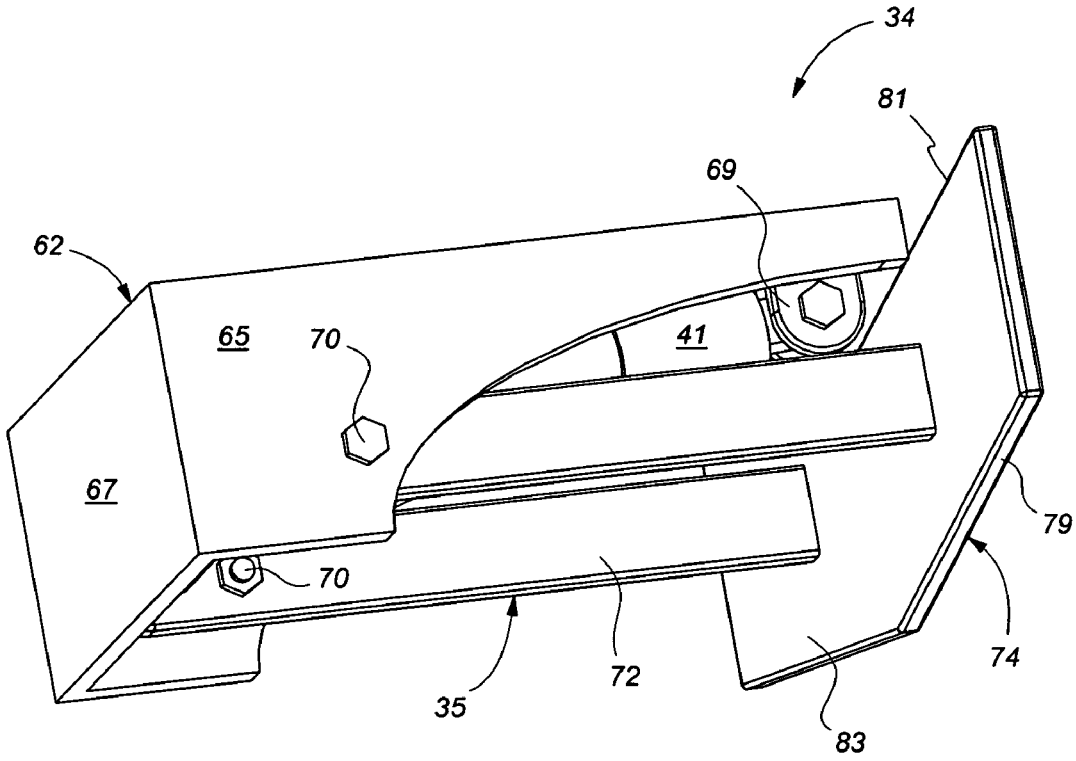
FIG. 5 is a perspective view of the wake modifier of FIG. 1, illustrating a stowed position.
Figure 6:
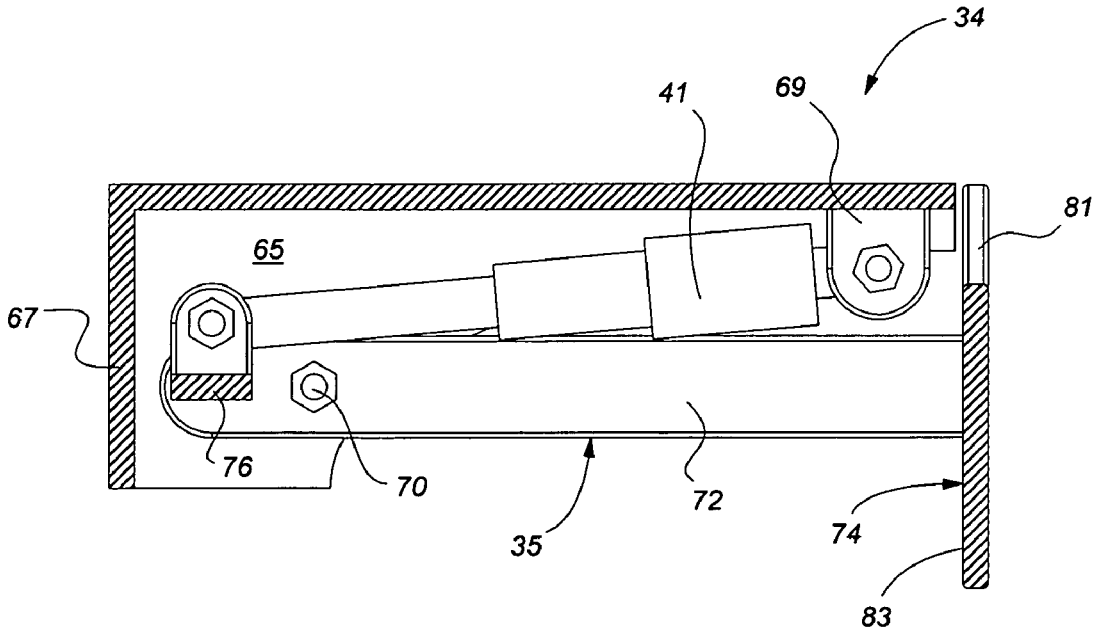
FIG. 6 is a cross-sectional side view of the wake modifier of FIG. 1 in the stowed position of FIG. 5.

In the illustrated embodiment, the forward attachment flanges are provided with similar fasteners (best seen in FIG. 3) to provide a pivotal connection between the actuators and the transverse bracket. As noted above, actuators 41 are pivotably secured to the mounting body 62 at an opposite end thereof. Actuators 41 are preferably linear actuators including electric motors, however, one will appreciate that other suitable actuators may be employed to move foil assembly 35 including, but not limited to, hydraulic and pneumatic motors. Actuators 41 allow for adjustably positioning foil assembly 35 between a deployed position, as shown in FIGS. 3 and 4, and a stowed position, as shown in FIGS. 5 and 6. In addition, actuators are also configured to position the foil assembly within a plurality of deployed positions in the flow of water, as will be discussed in greater detail below.

As actuators 41 extend or contract, arms 72 rotate about pivots 70. Such a configuration creates a fulcrum point about the pivot, however, alternative structures are envisioned. The pivots can be located anywhere along mounting body 62 or at ends of arms 72 to adjust the rotating motion of the arms. The arms may also be formed by a multibar linkage or replaced with other components suitable for effecting movement of the water foil. Use of a mounting body 62 instead of direct attachment of foil assembly 35 to watercraft 39 is preferable over attaching pivot points directly to the watercraft to alleviate concentrated stresses on the walls of the watercraft as well as to provide a discrete device which may be installed on a watercraft as an original equipment device or as an aftermarket device.

In the illustrated embodiment, two arms 72 are utilized, however, one will appreciate that two, three, four or more arms may be used. The two arm configuration allows each arm 72 to be offset from a longitudinal axis aft of the propeller and the rudder thereby minimizing any negative effects on propulsion and steering. Use of at least a pair of arms 72 also allows for a more rigid structure which is better suited to handle torsional and transverse forces on the foil assembly. The illustrated embodiment having a pair of arms advantageously allows for adjustably positioning the foil assembly and withstanding reactionary forces with minimal materials.

In the preferred embodiment, arms 72 are streamlined and have minimal cross-sections to reduce drag and to avoid deleterious effects on steering. In particular, the fore-to-aft dimensions of the arms, when in the deployed position, is minimal to prevent the arms from having a rudder-like effect. In the illustrated embodiment, the arms have a narrow foil-shaped cross-section in order to minimize turbulence across the arms and promote maneuverability. An irregular or blunt shape of the arms may create air pockets aft of the arms 72, which in turn move across foil 74 and obviate its effectiveness. An irregular flow of water across the arms 72 may also create a whistling sound. Likewise, if the arms are excessively wide, the arms may counter the steering of the rudder 49. Therefore, the arms preferably have a shape that promotes laminar flow and minimizes the disruption of water flow.

Foil 74 is secured to a lower end of arms 72. In the illustrated embodiment, the arms are attached to foil 74 at an angle of approximately 75°, but one will appreciate that the actual angle between the arms and the foil may depend on the overall configuration of the wake modifying device. As best shown in FIG. 3, with foil assembly 35 in an active or deployed position, foil 74 faces an incoming water flow at an attack angle $\alpha$. When the arms are rotated all the way down with actuators 41 fully retracted, an attack angle $\alpha$ of foil 74 is approximately 1° to 7° with respect to the longitudinal axis of the watercraft and the horizontal, preferably within approximately 3° to 5°, and most preferably approximately 4°. The angle between arms 72 and foil 74 is approximately 13–15°, preferably 14°. It has been found that with the above-described configuration and a 14° attachment angle the foil tends to move downward and establish equilibrium adjacent the lowest active position. Thus, at speed, the force on actuators 41 will be compressive even with foil 74 in an active position.

Foil 74 has a leading edge 79 and trailing edge 81. When water foil 74 is in an active position below the surface of the water, the leading edge enters the flow of water first. A transverse axis is formed through opposite corners of the leading edge. As shown in FIG. 4, the leading edge preferably extends along the transverse axis at a sweep angle $\theta$ in order to decrease drag when watercraft 39 is moving. Sweep angle $\alpha$ is preferably within the range of approximately 4°–12°.

In some embodiments of the present invention, water foil 74 has a non-planar cross-section configured for producing downward force when moving in the flow of water. Applying known methods employed in aeronautics and fluid dynamics, the shape of water foil 74 can be designed to create amplified downforce or negative lift.

Figure 7:
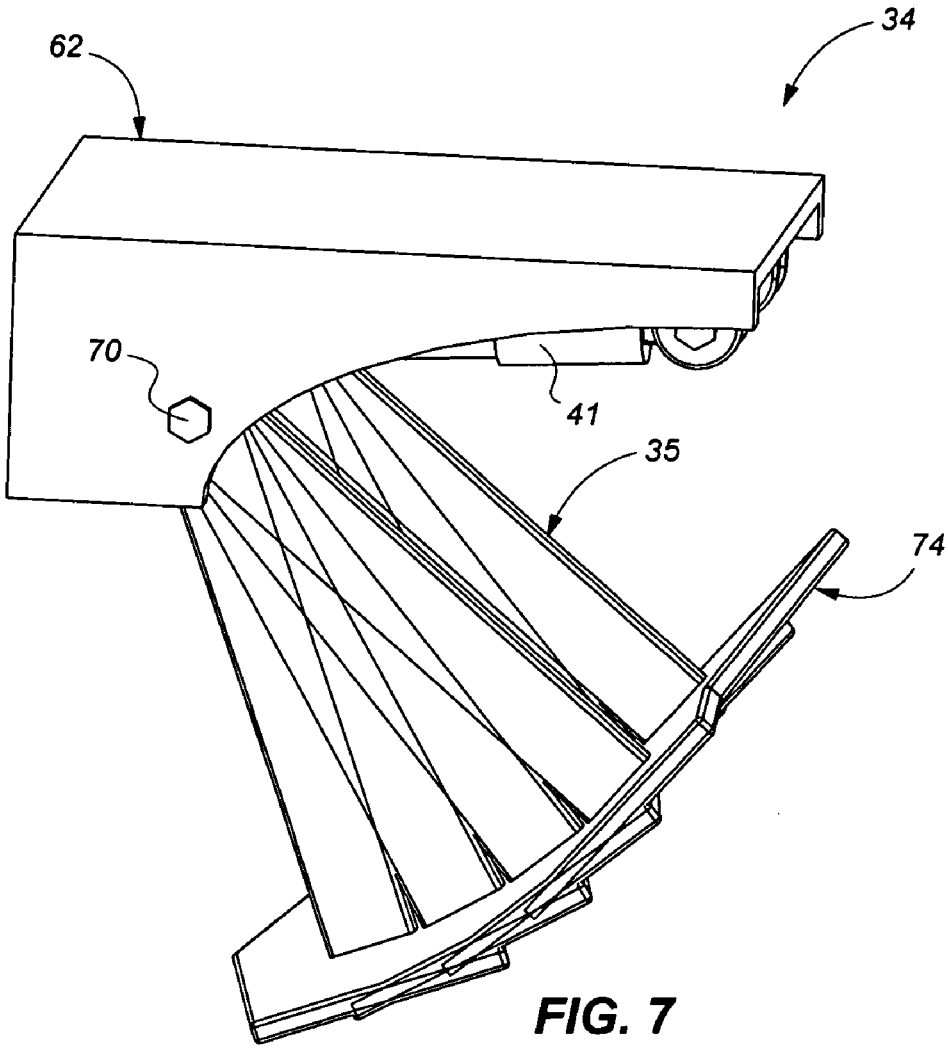
FIG. 7 is perspective view of the wake modifier of FIG. 1 illustrating variability with a plurality of operating positions.

Water foil 74 can be positioned in a stowed position, as shown in FIGS. 5 and 6, as well as a plurality of positions in the active area of the water flow, as shown in FIG. 7. When water foil 74 is in the stowed position, actuators 41 are fully extended between arms 72 and the rearward attachment flanges on mounting body 62. In the stowed position, foil assembly 35 and actuators 41 have a compact profile. In the preferred embodiment, actuators 41 and arms 72 are designed to collapse and fit substantially within a cavity formed by mounting body 62. In the stowed position, extended actuators 41 extend from the pivot points of forward attachment flanges 77 on the foil assembly rearward to the attachment flanges on the rear end of the mounting body. Thusly, as the actuators expand, the actuators rotate foil assembly 35 such that water foil 74 is positioned adjacent mounting body 62. Foil assembly 35 is preferably designed to allow foil 74 to stow aft of mounting body 62 in the stowed position to minimize air drag by foil 74. The compact profile also decreases the obtrusiveness of foil 74 in the stowed position.

Additionally, wake modifying device 34 is preferably mounted as close to the hull bottom 44 as possible and below a swim platform mounted on the swim platform mounts in an conventional manner. When watercraft 39 is moving, the water level will be near hull bottom 44. However, at idle, the water level will rise above the hull bottom and thus submerge wake modifying device 34. Generally, the space between the hull bottom and swim platform is in the range of ten to twelve inches.

Turning now to operation and use, controller 55 is configured to respond to inputs from the watercraft operator and/or to the onboard electronics of the watercraft. One will also appreciate that the controller may be configured to be operated by a remote user such as the wakeboarder and/or an observer traveling with the watercraft operator. Controller 55 is preferably programmed with predetermined parameters for added safety and reliability of the wake modifying system 83. According to these predetermined parameters, controller 55 outputs a control signal to actuators 41 in response to operational data of watercraft 39, which can be from the onboard electronics and/or operator inputs.

In one embodiment, the controller is configured to prevent movement of foil assembly 35 while a motor of watercraft 39 is idling or near idle, or if the watercraft is not moving. For example, the controller may be configured to prevent movement of the foil assembly unless the engine of the watercraft is operating above 1000 RPM. Preventing motion of the foil assembly 35 in such conditions may serve to prevent risk of injury to swimmers who are entering or exiting the watercraft. Thusly, in the this embodiment, controller 55 will send a control signal, or prohibit a control signal, to actuators 41 thus leaving the foil assembly motionless when the speedometer reads nearly zero or the engine is idling or off.

In operation and use, an operator can select a position for foil assembly 35 using control input 56 in a remote location, preferably on or adjacent the instrument panel 58. Preferably, the system is provided with an audible alarm that sounds when the foil assembly is being deployed from or retracted to the stowed position. In order to reduce the likelihood of injury, controller 55 is preferably programmed to prevent movement of foil assembly 35 from the stowed position of FIGS. 5 and 6, to the deployed positions of FIGS. 3 and 4 and/or the intermediate positions of FIG. 7 unless watercraft 39 is moving less than a threshold speed. In the illustrated embodiment, the threshold speed is about 10 miles per hour. This condition serves to prevent positioning the water foil in the water in excessive attack angles (e.g., greater than 45° to the longitudinal axis of the watercraft and to the horizontal) in order to keep the drag forces on the foil assembly within acceptable levels and prevent the watercraft from porpoising.

When towing a wakeboarder, an operator may select a position for the foil assembly 35 to modify the wake. Preferably, foil assembly 35 may be positioned at a plurality of angles within the active area, which active area extends from the fully deployed position of FIGS. 3 and 4 to an angle of approximately 45° to the longitudinal axis and to the horizontal. Preferably, the foil assembly can be positioned in the fully deployed position and in four, five or more intermediate positions within the active area. In such cases, the actuator may be in the form of a linear actuator having a step motor configured to position the foil assembly in the intermediate positions. More preferably, the actuator and controller are configured to position the foil assembly at any angle within the active area.

When the foil assembly 35 is placed in an active position, the flow of water imparts a force upon a top surface 83 of the foil 74. The reactionary force on the top surface imparts a downward force through arms 72 and through mounting body 62 and, in turn, causes the stern end 37 to be forced downward relative to the waterline. This, in turn, causes the stern to set lower in the water and to displace more water thus increasing the size of the wake. It has also been found to advantageously change the shape of the wake. Thus, the relative position of the stern of watercraft 39 can be adjusted thereby adjusting the wake of the boat on the fly, and without stopping to adjust weight distribution within the watercraft and/or to manually adjust watercraft accessories.

In the preferred embodiment, controller 55 is preset to only allow movement of foil assembly 35 under preset conditions to prevent failure of control system 83. Controller 55 preferably will not allow movement of foil assembly 35 between a stowed position and an active area when watercraft 39 is moving less than a predetermined threshold speed. In the preferred embodiment, the threshold speed is about 10 miles per hour. This condition prevents a user from lowering foil 74 from a stowed position into a flow of water at high speeds and potentially damaging wake modifying system 83. However, foil assembly 35 may be moved from an active area to the stowed position when watercraft 39 is below the predetermined threshold speed.

Additionally, controller 55 is preset to allow a user to select a position for foil assembly 35 when watercraft 39 is traveling within a certain speed range, preferably in the range of approximately 10 to 40 miles per hour. By setting an upper speed limit for actuation of foil assembly 35, the reliability of wake modifying system 83 may be increased. Furthermore, limiting adjustment of foil assembly 35 to speeds below approximately 40 miles per hour may lessen risk of damage to the wake modifying system and minimizes deleterious effects on handling.

Thus, in operation and use, a user can actively place the foil assembly into an active position for adjusting the wake for trick riding. When watercraft 39 is being used for cruising and traveling, foil assembly 35 can be alternatively raised to a stowed position for greater maximum speed and stability. In the illustrated embodiment, controller 55 will however override the user's input according to the foregoing operational conditions.

Additionally, the controller may be configured such that the foil assembly automatically moves to the stowed position as the watercraft is loaded on a trailer as well as in other applications outside of the water.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A wake modifying system for modifying a wake produced by a watercraft traveling through water, the system comprising:

a mounting member dimensioned and configured for attachment to the watercraft;

a foil dimensioned and configured for movement between a stowed position adjacent the mounting member, out of the water, and an active area below the mounting member, in the water, such that the foil lowers a relative position of a stern end of the watercraft in the water thereby modifying the wake produced by the watercraft traveling through the water;

a linkage movably securing the foil to the mount, the linkage being dimensioned and configured for adjustably positioning the foil in the stowed position and the active area;

an actuator mounted on the mounting member and connected to the linkage for moving the linkage such that the foil moves between the stowed position and the active area; and a controller for selectively actuating the actuator thereby selectively moving the foil between the stowed position and the active area.

2. The wake modifying system of claim 1, wherein the active area includes a plurality of active positions, wherein each active position of the foil modifies the wake in varying degree.

3. The wake modifying system of claim 2, wherein the plurality of active positions of the foil are incrementally spaced within the active area.

4. The wake modifying system of claim 3, wherein the actuator is a step motor configured for moving the foil between the incrementally spaced active positions.

5. The wake modifying system of claim 1 in combination with a watercraft, wherein the mounting member is mounted to a transom of the watercraft.

6. The wake modifying system of claim 1, wherein the actuator includes at least one linear actuator having one end pivotally attached to the mounting member and another end pivotally attached to the linkage, and the controller being configured to output a control signal to the at least one linear actuator such that the actuator moves the linkage to move the foil between the stored position and active area.

7. The wake modifying system of claim 1, wherein the controller is configured for control by a user within the watercraft.

8. The wake modifying system of claim 1, wherein the controller is configured to control the actuator in response to one or more operational parameters of the watercraft.

9. The wake modifying system of claim 8, wherein the controller is configured to prohibit the actuator from moving the linkage and foil between the stored position and active area unless speed of the watercraft is less than a predetermined threshold speed.

10. The wake modifying system of claim 9, wherein the predetermined threshold speed is approximately 10 miles per hour.

11. The wake modifying system of claim 8, wherein the controller is configured to allow the actuator to move the linkage and foil between a plurality of active positions within the active area when the speed of the watercraft is above the predetermined threshold speed but below a predetermined maximum speed.

12. The wake modifying system of claim 11, wherein the predetermined maximum speed is approximately 25 miles per hour.

13. The wake modifying system of claim 8, wherein the controller is configured to prevent the actuator to move the linkage and foil between a plurality of active positions within the active area when the speed of the watercraft is greater than approximately 10 miles per hour.

14. The wake modifying system of claim 8, wherein the controller prohibits the actuator from moving the linkage and the foil when the speed of the watercraft is approximately zero.

15. A wake modifying system for modifying a wake produced by a watercraft moving through water, the system comprising:

a mounting body, the mounting body being configured to be secured to the watercraft;

a linkage including an arm being pivotably attached at an upper end thereof to the mounting body;

a water foil attached to a lower end of the arm, the water foil being dimensioned and configured for movement between a stowed position adjacent the mounting body and out of the water and an active area below the mounting member and in the water, the water foil being configured for enhancing the wake produced by the moving watercraft; and an actuator pivotably attached at one end to the mounting body and pivotably attached at another end to the arm adjacent the upper end;

wherein the actuator is configured for positioning the arm and the water foil in response to a control signal.

16. The wake modifying system of claim 15 wherein the mounting body is secured to a transom of the watercraft.

17. The wake modifying system of claim 15 wherein the linkage includes a pair of arms, each arm being pivotably attached at an upper end thereof to the mounting body and attached at a lower end thereof to the water foil, wherein the actuator is configured to stow between the pair of arms when the foil is in the stowed position.

18. The wake modifying system of claim 17 wherein in the stowed position, the actuator is positioned substantially within a cavity formed by the mounting body and the pair of arms, and the foil is positioned aft of the mounting body.

19. The wake modifying system of claim 17 wherein the mounting body includes:

a forward mounting plate;

opposing sidewalls extending from side edges of the mounting plate, each sidewall having a pivot point for pivotal attachment of a respective one of said arms; and a top member extending from an upper edge of the mounting plate and interconnecting the sidewalls, a rear portion of the top member forming an attachment portion to which the actuator is pivotably attached.

20. The wake modifying system of claim 15 wherein the water foil has a leading edge and trailing edge, the leading edge extends along a transverse axis at a sweep angle.

21. The wake modifying system of claim 15 wherein the water foil has a non-planar cross-section configured for producing downforce when in the active area and moving through water.

22. The wake modifying system of claim 15 wherein the water foil is dimensioned and configured to be positioned between 0 degrees and 45 degrees relative to the longitudinal axis of the watercraft.

23. The wake modifying system of claim 15 wherein a fore-and-aft dimension of the arms is substantially less than a fore-and-aft dimension of the water foil.

24. A method of modifying a wake produced by a watercraft moving through water, the method comprising the steps of:

providing a water foil dimensioned and configured to lower the relative position of a stern end of the watercraft moving through water relative to the waterline;

providing an actuator to move the water foil from a stored position out of the water to an active area in the water, wherein the relative angle of the water foil within the active area varies the amount of adjustment of the relative position; and remotely controlling the actuator to selectively move the water foil.

25. The method of modifying a wake of claim 24, further comprising:

incrementally controlling the relatively angle of the water foil within the active area to modify the wake in varying degree.

26. The method of modifying a wake of claim 24, wherein the remotely controlling step is accomplished by a user controlling the actuator remotely from within the watercraft.

27. The method of modifying a wake of claim 24, wherein the remotely controlling step is accomplished by automatically controlling the actuator in response to one or more operational parameters of the watercraft.

28. The method of modifying a wake of claim 24, further comprising:

prohibiting the actuator from moving the linkage and foil between the stored position and active area unless speed of the watercraft is less than a predetermined threshold speed.

29. The method of modifying a wake of claim 24, further comprising:

allowing the actuator to move the linkage and foil between a plurality of active positions within the active area when the speed of the watercraft is above the predetermined threshold speed but below a predetermined maximum speed.

30. The method of modifying a wake of claim 24, further comprising:

allowing the actuator to move the linkage and foil between a plurality of active positions within the active area when the speed of the watercraft is greater than approximately 10 miles per hour.

31. The method of modifying a wake of claim 24, further comprising:

preventing the actuator from moving the linkage and the foil when the speed of the watercraft is approximately zero.

* * * * *

UNITED STATES PATENT AND TRADEMARK OFFICE

CERTIFICATE OF CORRECTION

PATENT NO. : 7,140,318 B1
APPLICATION NO. : 11/301852
DATED : November 28, 2006
INVENTOR(S) : Daniel L. Gasper It is certified that error appears in the above-identified patent and that said Letters Patent is hereby corrected as shown below:

ON THE TITLE PAGE item (56),

In Col. 2, under "OTHER PUBLICATIONS," add the following publication:

*Switch Blade Wake Enhancement System*, http://www.switchbladewake.com/, date unknown, Pivotal Designs, Inc., Benton, Illinois.

Col. 8, line 24, change "angle α" to --angle θ--.

Signed and Sealed this

Twenty-eighth Day of August, 2007

JON W. DUDAS
*Director of the United States Patent and Trademark Office*